US006809658B1

(12) United States Patent
Lofaso

(10) Patent No.: US 6,809,658 B1
(45) Date of Patent: Oct. 26, 2004

(54) ELECTRONIC FISH COUNTER APPARATUS

(76) Inventor: Daryl P. Lofaso, 15 Lorio La., Mandeville, LA (US) 70448

( * ) Notice: Subject to any disclaimer, the term of this patent is extended or adjusted under 35 U.S.C. 154(b) by 0 days.

(21) Appl. No.: 10/359,920

(22) Filed: Feb. 6, 2003

(51) Int. Cl.[7] ..... G08B 23/00

(52) U.S. Cl. ..... 340/984; 43/17; 43/9.3; 43/55; 206/315.11

(58) Field of Search ..... 340/984, 323 R; 116/222, 325; 43/55, 17, 54.1, 4, 9.3; 206/315.11; 273/282.1, DIG. 26; 235/90

(56) References Cited

U.S. PATENT DOCUMENTS

| | | | | |
|---|---|---|---|---|
| 4,516,348 A | 5/1985 | Hirose et al. | ..... | 43/17 |
| 4,693,125 A | 9/1987 | Krutz et al. | ..... | 43/17 |
| 4,753,031 A | 6/1988 | Owen | ..... | 43/54.1 |
| 5,156,291 A | 10/1992 | Mielke | ..... | 43/55 |
| 5,388,547 A | 2/1995 | Lehr et al. | ..... | 43/1 |
| 5,637,838 A | 6/1997 | Arey et al. | ..... | 33/511 |
| 5,941,016 A | 8/1999 | Welcher | ..... | 43/55 |
| 5,979,752 A | 11/1999 | Holloway | ..... | 235/90 |
| 6,584,722 B1 * | 7/2003 | Walls et al. | ..... | 43/4 |

* cited by examiner

*Primary Examiner*—Brent A. Swarthout
(74) *Attorney, Agent, or Firm*—Garvey, Smith, Nehrbass & Doody, L.L.C.; Gregory C. Smith

(57) ABSTRACT

An apparatus for maintaining an accurate count of multiple species of fish caught by multiple fishermen, the system including an electronic counter, having a face plate comprising a first numerical LCD display; a counter button for increasing the numerical LCD display when the button is struck; a reset button for resetting the numerical LCD display to zero when depressed; a second button for increasing or decreasing the number displayed on the numerical LCD display depending on the part of the second button depressed; at least a second set of numerical LCD display; counter button; and second button for allowing at least two individuals to utilize the counting system during fishing; means for securing the counting system to a fixture on a boat for easy access as fish are caught and being counted; and battery-powered electronics to carry out the functions. There is further provided a name select button, which when depressed selects the name of the fish caught, whether salt or fresh water species, before pressing the numerical LCD display button to record the number.

16 Claims, 2 Drawing Sheets

ELECTRONIC FISH COUNTER APPARATUS

CROSS-REFERENCE TO RELATED APPLICATIONS

Not applicable

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The apparatus of the present invention relates to fishing equipment. More particularly, the present invention relates to an apparatus and system for counting certain species of fish among multiple fishermen to maintain an accurate count on fish caught and kept.

2. General Background of the Invention

In the sport of fishing, particularly where certain species, such as trout, redfish, red snapper, and others are highly regulated, fishermen are required to maintain a very accurate account of the number of fish they have caught and are bringing in at the end of a trip. The states regulate the maximum number of for example, speckled trout, a fisherman can catch and keep. If the fisherman, or if multiple fishermen, have a total count at the end of a trip, which exceeds the maximum allowed, there are stiff fines imposed on the fishermen. This chore of keeping track of the number of fish caught, particularly when the fish are biting, a multiple fish are being reeled into the boat, becomes even more difficult to achieve. Coupled with that is the fact that if the fishermen want to maintain an individual count so that at the end of a trip, each person in the boat knows the number of fish he or she caught, the counting and tracking of the fish increases in difficulty.

There have been patents issued on methods or systems of counting fish, and those of which the applicant is aware are listed in the Information Disclosure Statement filed herewith.

BRIEF SUMMARY OF THE INVENTION

The apparatus and system of the present invention solves the problems in the art in a simple and straightforward manner. What is provided is a system for maintaining an accurate count of multiple species of fish caught by multiple fishermen, the system including an electronic counter, having a face plate comprising a first numerical LCD display; a counter button for increasing the numerical LCD display when the button is struck; a reset button for resetting the numerical LCD display to zero when depressed; a second button for increasing or decreasing the number displayed on the numerical LCD display depending on the part of the second button depressed; at least a second set of numerical LCD display; counter button; and second button for allowing at least two individuals to utilize the counting system during fishing; means for securing the counting system to a fixture on a boat for easy access as fish are caught and being counted; and battery-powered electronics to carry out the functions. There is further provided a name select button when depressed selects the name of the fish caught, whether salt or fresh water species, before pressing the numerical LCD display button to record the number.

Therefore, it is a principal object of the present invention to provide a system for counting fish which allows for tracking electronically the number of a certain species of fish caught, and by whom the fish were caught;

It is a further object of the present invention to provide alternate embodiments for counting fresh water species of fish and salt water species of fish;

It is a further object of the present invention to provide a system which allows the electronic counter to be placed in a convenient location on a boat for keeping instantaneous count of fish yet providing a means for increasing or decreasing the count should fish be added or withdrawn from the catch;

It is a further object of the present invention to provide different variations of the device for allowing multiple fishermen to count certain species of fish during the course of the fishing trip.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
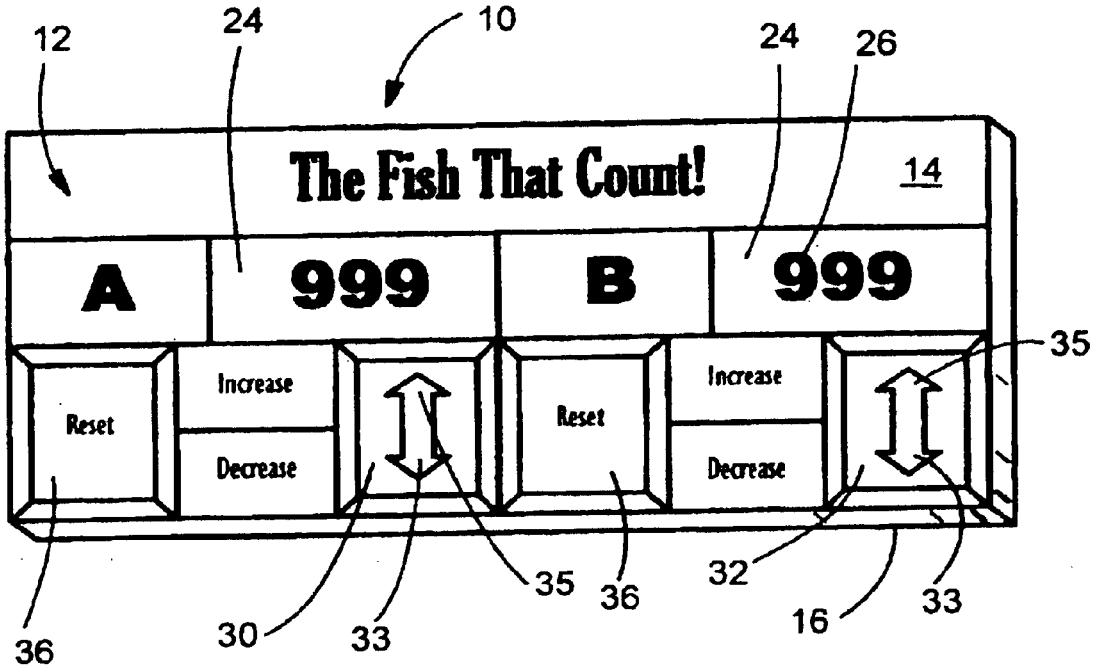
FIG. 1 illustrates the preferred embodiment of the present invention utilized with multiple fisherman.
Figure 4:
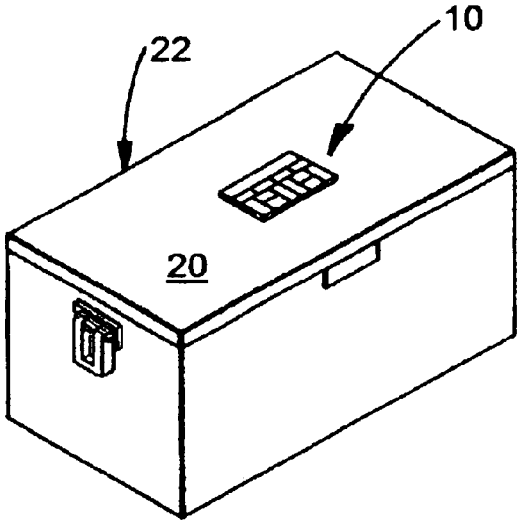
FIG. 4 illustrates the preferred embodiment of the present invention secured to the top of an ice chest.

FIGS. 1 through 4 illustrate the preferred embodiment of the present invention by the numeral 10. As illustrated first in Figure, the electronic counter 10 includes a pad 12 having a face 14, a rear wall 16, and an interior (not illustrated) which would house the electrical components, which would preferably be battery operated, for providing the functions of the present invention. The electrical components utilized would comprise off the shelf electronics which would allow the electronic counter to function and display the results. The rear wall 16 would be attachable to a surface such as the top 20 of an ice chest 22, as seen in FIG. 4, the top of a console of a fishing boat, or any other flat surface, allowing easy access thereto during a fishing trip. As illustrated in FIG. 1, face 14 would include a plurality of indicia for operating the counter 10. First there is provided a numerical LCD 'display screen 24, having the ability to display numbers 26 up to three digits. There would be provided at least two display screens 24, each displaying numbers 26. Beside each of the display screens 24, there is provided a first letter A and a second letter B, each of which represent the two fishermen which would be utilizing the apparatus 10. Of course if there were more than two fishermen, there would be additional letters to relate to each fishermen. For purposes of function, as previously stated, the displayed letters A and B would be each assigned to a particular fisherman in the boat; in this case two fishermen. There would be further provided Up/Down buttons 30, 32 for each of the screens 24, each of the buttons 30, 32, illustrating a downward arrow 33 and an upward arrow 35. Adjacent each of the Up/Down buttons 30, 32, there would be provided the words "Increase" and "Decrease." In the event a fisherman A, for example, would need to adjust the count showing on the display screen 24, either upward or downward, fisherman A would depress the button 30. If the adjustment was to increase the count, fisherman A would depress upward arrow 35, and if it was to decrease the count, which may occur if fish had to be returned to the water, fisherman A would depress the downward arrow 33 portion of button 30. Each strike of the downward arrow 33 would decrease the count shown on the screen 24 by one fish as it relates to fisherman A. Of course, the same process would also apply to fisherman B, as is seen in FIG. 1.

When the fishing trip is complete, each fisherman A and B would depress a reset button 36, so that the count shown on screen 24 would return to zero. The reset button 36 would preferably have a five second delay when depressed, so as to avoid an inadvertent pressing of the reset button 36 which would delete the fish count, were it not for the five second delay feature.

Figure 2:
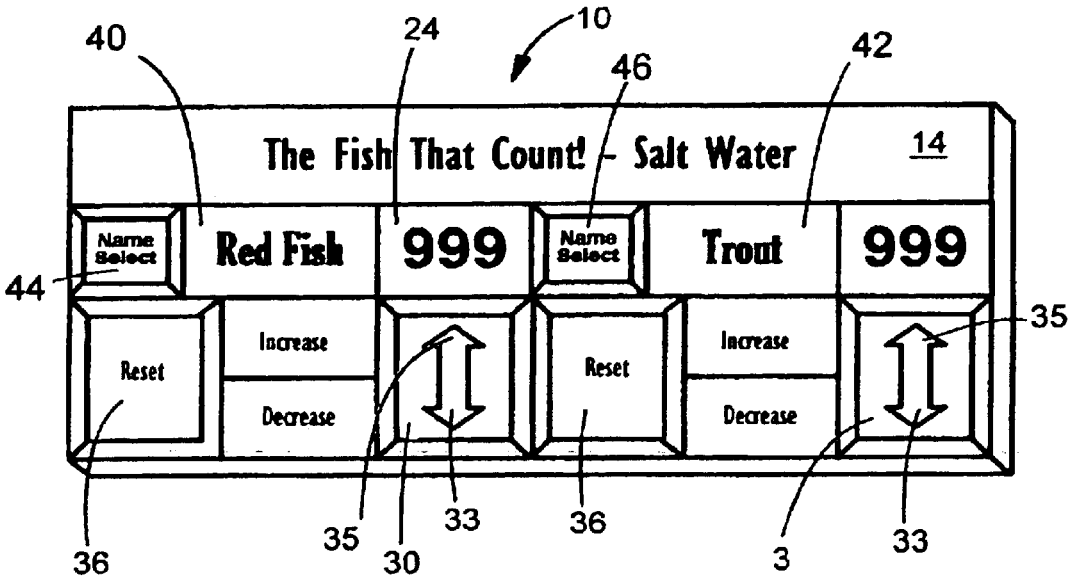
FIG. 2 illustrates the preferred embodiment of the present invention for counting multiple species of salt water fish.

Turning now to FIG. 2, in this particular embodiment of the electronic counter 10, the counter would be set up in the same fashion, only showing different indicia on its face 14 for counting species of salt water fish. As illustrated, the counter would still include the LCD numerical display screen 24, as discussed in FIG. 1. The counter 10 would also include the buttons 30, 32 with the upward arrow 35 and downward arrow 33. There would also be included the reset buttons 36 for each fisherman to reset to zero at the end of the trip. However, in this embodiment, rather than have a letter A and letter B for indicating fishermen, there would be a second fish name LCD display screens 40 and 42, where the name of the fish would be displayed. The name of the fish, for example, as seen in the FIG. 2, "Red Fish" on the fish name LCD 40 would be displayed by pressing the name select button 44. The button would be depressed until the particular salt water fish, in this case, red fish, is displayed. The fisherman would then press the increase upward arrow 35 to show a number on the numerical display screen 24 for an additional redfish caught.

As seen further in FIG. 2, should the fisherman catch a "Trout," the fisherman would press the name select button 46, which relates to the second fish name screen 42, which would show "Trout," and then press the second upward arrow 35 to increase the number on the second display screen 24 to show an increase of "trout" caught. In this embodiment, therefore, the number of species of a certain fish, in this case, red fish and trout, can be totaled by the fishermen.

Figure 3:
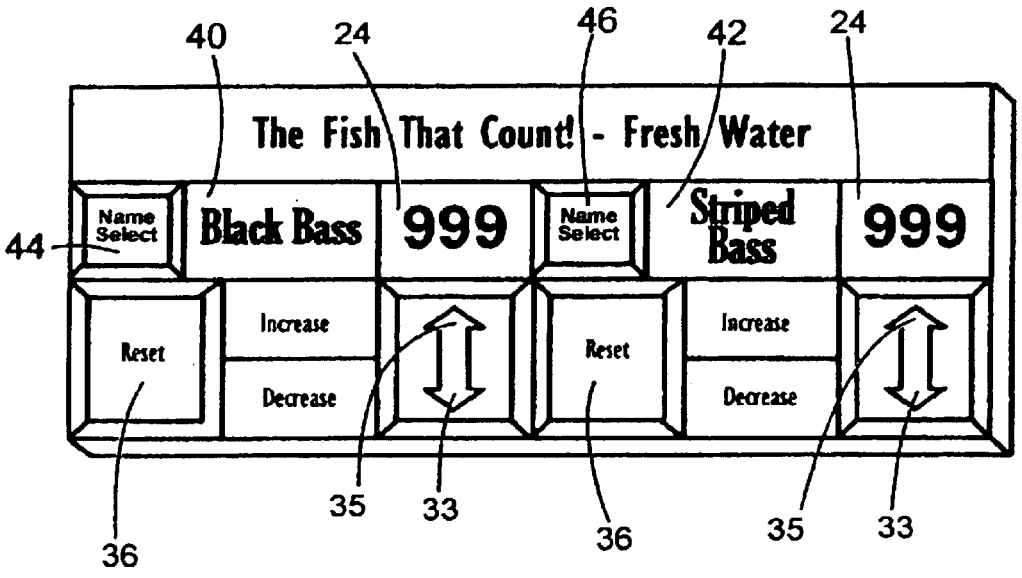
FIG. 3 illustrates the preferred embodiment of the present invention for counting multiple species of fresh water fish.

FIG. 3 illustrates an exact duplicate of the indicia illustrated in FIG. 2, but for the fact that the counter is set up to count fresh water fish, in this case "Black Bass," and "Striped Bass." However, all of the functions as discussed in relation to FIG. 2 are present in FIG. 3 in the same manner is set forth above.

As seen further in FIGS. 1 through 3, the counter could include a trademark such as "The Fish That Count" across its upper surface which may designate whether the counter is for multiple fishermen, fresh water fish or salt water fish.

It is foreseen that the present invention, for example, in FIG. 1, illustrates two fisherman, could be expanded to include a greater number than two, or multiple counters 10 could be used for multiples of two fisherman in the boat. The same may be true for the fish species counter 10 as illustrated in FIGS. 2 and 3. Additionally, it is foreseen that the counter illustrated in FIG. 1, which keeps a count of fish for each fisherman A and B, could be used in combination with the counters 10 shown in FIGS. 2 and 3. In additional embodiments, a single counter may be developed which would have incorporated all of the features illustrated in FIGS. 1 through 3, so that multiple fishermen may be able to keep count of multiple species of either salt or fresh water fish caught.

For purposes of operation, the electronic components within the counter would be components which are known in the art, for example, of the type used currently with electronic calculators on the market, or other type of electronic instruments, such as palm pilots, which display both numerical and alphabetical indicia on their face. However, applicant believes that utilizing the known electronic components in the manner to carry out the function of the present invention is novel.

Parts List

The following is a list of suitable parts and materials for the various elements of the preferred embodiment of the present invention.

electronic counter 10
pad 12
face 14
rear wall 16
interior 18
top 20
ice chest 22
numerical LCD display screen 24
numbers 26
labels A and B
Up/Down buttons 30, 32
downward arrow 33
upward arrow 35
reset buttons 36
fish name LCD display screens 40, 42.
name select buttons 44, 46

The foregoing embodiments are presented by way of example only; the scope of the present invention is to be limited only by the following claims.

What is claimed is:

1. An electronic fish counter apparatus mountable on a boat, comprising:

a. a face portion;

b. at least one display screen on the face portion for displaying the number of fish caught by at least one fisherman;

c. a depressible button relating to the display screen for displaying additional fish caught by the displayed number on the display screen which relates to the number of fish caught by the fisherman;

d. a second button for increasing or decreasing the number on the display screen depending on which portion of the second button is depressed.

2. The apparatus in claim 1, wherein the apparatus is mountable on a surface such as an ice chest or a center console of the boat.

3. The apparatus in claim 1, wherein there may be provided a plurality of display screens, each relating to an individual fisherman.

4. The apparatus in claim 1, wherein there may be further provided a second display screen on the face portion for displaying the name of a particular species of fish caught as indicated by the number on the second display screen.

5. The apparatus in claim 4, wherein the species of fish relate to salt water and fresh water species.

6. The apparatus in claim 1, wherein the display screens display the information in a readable LCD display format.

7. The apparatus in claim 1, wherein there is further provided a reset button for resetting the fish count to zero when appropriate.

8. An electronic fish counter apparatus mountable on a boat, comprising:

a. a face portion;

b. at least two numerical display screens on the face portion for displaying the number of fish caught by at least two fisherman;

c. a depressible button relating to each of the display screens for counting and displaying additional fish caught by the two fishermen as the fish are caught; and d. a second button for increasing or decreasing the number on each display screen depending on which portion of the second button is depressed.

9. The apparatus in claim 8, wherein there may be further provided a second display screen on the face portion for displaying the name of a particular species of fish caught as indicated by the number on the second display screen.

10. The apparatus in claim 9, wherein the species of fish relate to salt water and fresh water species.

11. The apparatus in claim 8, wherein the display screens display the information in a LCD display format.

12. The apparatus in claim 8, wherein there is further provided a reset button for resetting the fish count to zero when appropriate.

13. An electronic fish counter mountable on a boat, comprising:

a. a face portion;

b. at least two numerical display screens on the face portion for displaying the number of fish caught by at least two fisherman;

c. a depressible button relating to each of the display screens for counting and displaying additional fish caught by the two fishermen as the fish are caught;

d. a second button for increasing or decreasing the number on each display screen depending on which portion of the second button is depressed; and e. a second display screen on the face portion for displaying the name of a particular species of fish caught as indicated by the number on the display screen.

14. The apparatus in claim 13, wherein the display screens display the information in a LCD display format.

15. The apparatus in claim 13, wherein the apparatus is mountable on a surface such as an ice chest or a center console of the boat.

16. The apparatus in claim 13, wherein the species of fish relate to salt water and fresh water species.

* * * * *